US008079189B2

(12) United States Patent
Qu et al.

(10) Patent No.: US 8,079,189 B2
(45) Date of Patent: Dec. 20, 2011

(54) STRUCTURE SYSTEM OF CONCRETE BUILDING FOR SELF-HEAT INSULATION

(76) Inventors: Ping Qu, Jiangsu (CN); Xinfu Chen, Jiangsu (CN)

( * ) Notice: Subject to any disclaimer, the term of this patent is extended or adjusted under 35 U.S.C. 154(b) by 236 days.

(21) Appl. No.: 12/089,736

(22) PCT Filed: Apr. 12, 2007

(86) PCT No.: PCT/CN2007/001189

§ 371 (c)(1),
(2), (4) Date: Apr. 10, 2008

(87) PCT Pub. No.: WO2007/134518

PCT Pub. Date: Nov. 29, 2007

(65) Prior Publication Data

US 2010/0218446 A1 Sep. 2, 2010

(30) Foreign Application Priority Data

May 18, 2006 (CN) ..... 2006 1 0092167

(51) Int. Cl.
*E04B 1/04* (2006.01)
*E04B 1/16* (2006.01)

(52) U.S. Cl. ..... 52/383; 52/236.6; 52/251; 52/405.2

(58) Field of Classification Search ..... 52/236.6, 52/236.7, 236.8, 250, 251, 258, 259, 265, 52/268, 405.1, 405.2, 405.3, 405.4, 439, 52/442, 667

See application file for complete search history.

(56) References Cited

U.S. PATENT DOCUMENTS

| | | | | | |
|---|---|---|---|---|---|
| 1,072,230 | A | * | 9/1913 | Howard | 52/293.1 |
| 1,380,324 | A | * | 5/1921 | Piggins | 52/283 |
| 2,063,309 | A | * | 12/1936 | Graef | 52/410 |
| 2,111,562 | A | * | 3/1938 | Hughson | 249/179 |
| 2,164,137 | A | * | 6/1939 | London | 52/330 |
| 2,208,589 | A | * | 7/1940 | Leemhuis | 52/293.1 |
| 2,303,837 | A | * | 12/1942 | Gurber | 52/426 |
| 2,592,634 | A | * | 4/1952 | Hart | 52/584.1 |
| 2,769,332 | A | * | 11/1956 | Brown, Jr | 52/262 |
| 3,415,023 | A | * | 12/1968 | Lebreton | 52/213 |
| 3,507,738 | A | * | 4/1970 | Prusinski et al. | 428/71 |

(Continued)

FOREIGN PATENT DOCUMENTS

CH 627808 A * 1/1982

(Continued)

*Primary Examiner* — Brian Glessner
*Assistant Examiner* — Joseph J Sadlon
(74) *Attorney, Agent, or Firm* — Schmeiser, Olsen & Watts, LLP

(57) ABSTRACT

A structure system of concrete building for self-heat insulation comprises a wall (1), a link beam (2) and a floor slab (3). The wall is composed of a prefabricated concrete wall for heat insulation (11) and a cast-in-place concrete wall (12). The prefabricated concrete wall (11) is a concrete panel (5), one surface of which is covered with heat insulation layer (4), and the prefabricated concrete wall (11) and the cast-in-place concrete wall (12) are cast and folded to be an integral. At the joint of the link beam and an outer wall, the link beam and the top and bottom cast-in-place concrete walls are cast to be an integral. The outer end of the link beam is covered with heat insulation layer. At the joint of the floor slab and the link beam, they are cast to be an integral.

11 Claims, 7 Drawing Sheets

U.S. PATENT DOCUMENTS

| | | | | | |
|---|---|---|---|---|---|
| 3,559,355 | A | * | 2/1971 | Thorndyke, Jr | 52/251 |
| 3,662,506 | A | * | 5/1972 | Dillon | 52/251 |
| 4,019,293 | A | * | 4/1977 | Armas | 52/79.11 |
| 4,095,380 | A | * | 6/1978 | Dillon | 52/79.13 |
| 4,098,042 | A | * | 7/1978 | Sachs et al. | 52/383 |
| 4,181,286 | A | * | 1/1980 | Van Doren | 249/82 |
| 4,291,513 | A | * | 9/1981 | Ankarswed | 52/284 |
| 4,350,483 | A | * | 9/1982 | Bonnet | 425/115 |
| 4,628,653 | A | * | 12/1986 | Nash | 52/309.12 |
| 4,655,016 | A | * | 4/1987 | Jacob | 52/169.1 |
| 4,669,240 | A | * | 6/1987 | Amormino | 52/236.6 |
| 4,909,001 | A | * | 3/1990 | Gonzalez Espinosa de Los Monteros | 52/92.2 |
| 5,647,177 | A | * | 7/1997 | Hwang | 52/79.5 |
| 5,673,525 | A | | 10/1997 | Keith et al. | |
| 5,697,196 | A | * | 12/1997 | SalahUddin | 52/379 |
| 5,927,032 | A | * | 7/1999 | Record | 52/309.11 |
| 5,934,036 | A | * | 8/1999 | Gallagher, Jr. | 52/323 |
| 6,041,561 | A | * | 3/2000 | LeBlang | 52/234 |
| 6,293,063 | B2 | * | 9/2001 | Van Doren | 52/251 |
| 6,401,417 | B1 | * | 6/2002 | Leblang | 52/481.1 |
| 6,637,167 | B2 | * | 10/2003 | Hanna | 52/223.7 |
| 2004/0068948 | A1 | * | 4/2004 | Wrass | 52/309.7 |

FOREIGN PATENT DOCUMENTS

| | | | | |
|---|---|---|---|---|
| CH | 627808 | A5 | * | 1/1982 |
| CH | 640908 | A | * | 1/1984 |
| CH | 640908 | A5 | * | 1/1984 |
| CN | 2594343 | | | 12/2003 |
| EP | 3268 | A1 | * | 8/1979 |
| EP | 10238 | A1 | * | 4/1980 |
| FR | 2598449 | | | 11/1987 |
| FR | 2598449 | A1 | * | 11/1987 |

* cited by examiner

1—1

2—2

2—2

STRUCTURE SYSTEM OF CONCRETE BUILDING FOR SELF-HEAT INSULATION

TECHNICAL FIELD

This invention relates to a type of concrete building, in particular a structure system of concrete building for heat insulation.

BACKGROUND OF THE INVENTION

Existing house buildings include low building, multistory building, minor high-rise building, high-rise building, and super high-rise building according to heights. In China, low buildings and multistory buildings are mostly masonry building or concrete frame building, minor high-rise buildings and high-rise buildings are mostly concrete building, and super high-rise buildings are mostly steel structure building or section steel plus concrete combined structure building.

Present masonry building structure system normally has poor antiseismic properties and mostly uses clay bricks. Large amount of clay resource is used, seriously damaging farmland and affecting sustainable development of agriculture. Present concrete buildings mostly adopt cast-in-place concrete structure system. Large amount of timber needs to be used to fabricate formwork, seriously exhausting forest resource and affecting environment and climate.

All existing masonry buildings and cast-in-place concrete building structures adopt site construction involving high manual labor strength, low level of factory production, many sequences, high costs and long construction period.

Existing building energy conservation technology has been developed without changing existing building structure system. Heat insulation technology includes exterior wall exterior heat insulation and exterior wall interior heat insulation. In the former technology, heat insulation layer is added on outdoor surface of exterior wall; in the latter technology, heat insulation layer is added on inner surface of exterior wall. In terms of material, heat insulation layer can be of plate material or slurry material. No matter plate or slurry, existing building exterior wall energy conservation technology has the apparent disadvantages of many sequences, high cost, poor effect, low safety, service life shorter than 15 years, and unsuitability on interior wall etc.

From nineteen forties to nineteen seventies, large concrete slab buildings appeared home and abroad. In such buildings, complete concrete wall slabs and floor slabs are used as basic members of building, so as to realize factory production and assembling installation. To save materials, large porous concrete slab building was invented in China; however, such building has poor overall performance and cannot satisfy comfort requirements as proven by practice.

DETAILED DESCRIPTION

The purpose of the present invention it to provide a self-heat insulated concrete building structure system with high performance concrete structure material and high efficiency heat insulation material as main materials, to overcome aforesaid defects of existing technology provided that basic state policies of antiseismic properties, energy saving, land saving, environmental protection, no use of clay bricks, less use of wood formwork and saving of non-renewable resources are fully satisfied. This structure system is suitable for factory production and mechanized construction, and safe, reliable and cheap. Service life reaches 50 years.

Technical scheme of this invention: A structure system of concrete building for self-heat insulation, comprising a wall, a link beam and a floor slab, characterized by said wall consisting of a prefabricated concrete wall for heat insulation and a cast-in-place concrete wall. The prefabricated concrete wall for heat insulation is a concrete panel, one surface of which is covered with a heat insulation layer. The prefabricated concrete wall for heat insulation and the cast-in-place concrete wall are cast and folded to be an integral. At joint of said link beam and an outer wall, cast-in-place link beam and top and bottom cast-in-place concrete walls are cast to be an integral. The outer end of the link beam is covered with heat insulation layer. At joint of floor slab and link beam, cast-in-place link beam and said floor slab are cast to be an integral.

Aforesaid wall can be partially heat insulating or completely heat insulating.

Said floor slab can also be heat insulated and comprise prefabricated concrete floor slab for heat insulation and cast-in-place concrete floor slab. Prefabricated concrete floor slab for heat insulation includes concrete panel and heat insulation layer covering this panel. On the concrete panel, spike dowels are provided and fixed on reinforcement cage of cast-in-place concrete floor slab. Cast-in-place floor slab and prefabricated concrete floor slab for heat insulation are cast to be an integral, with heat insulation layer in between.

In said prefabricated concrete floor slab for heat insulation, concrete slabs are in the shape of groove, in which a number of cross ribs are provided. Heat insulation layer is arranged in such grooves and spike dowels are arranged on ribs around grooves and on cross ribs. Cross ribs can consolidate bonding between prefabricated concrete floor slab for heat insulation and cast-in-place concrete floor slab.

In said prefabricated concrete floor slab for heat insulation, nearly evenly distributed spike dowels are provided on concrete panel and holes are reserved in heat insulation layer at these spike dowels. One end of spike dowels is projected from heat insulation layer. Bonding between cast-in-place concrete floor slab and prefabricated concrete floor slab for heat insulation is enhanced by spike dowels penetrating these holes. Two layers of concrete floor are isolated by heat insulation layer, and the only connection is by concrete stubs of spike dowels. In this way, hot (cold) bridges are reduced and better heat insulation is provided.

Concrete panel used for said prefabricated concrete wall and floor slab for heat insulation adopts prestressed concrete or reinforced concrete. Material of said heat insulation layer can be polystyrene foam or other organic foam. Said cast-in-place concrete wall and floor adopt reinforced concrete.

In this invention, an outer surface 7 of prefabricated concrete panel 11 for insulation used as wall is provided with ornamental motif or grooves for embedded pipelines, to replace additional (stuck) facing or avoid secondary cutting of grooves on wall surface, thereby saving investment and facilitating construction.

Beneficial effect of this invention lies in that heat insulation layer is provided inside concrete wall and floor slab, and on outer side of link beam, effectively blocking shortcut of heat transfer and providing good heat insulation. At the same time, during construction, prefabricated concrete wall and floor slab are used as permanent formwork for cast-in-place concrete members, and cast to be an integral with cast-in-place concrete members. After completion of construction, such formwork needs not be removed, reducing construction sequences, shortening construction period, simplifying process, and reducing costs.

When this invention is used for multistory building or minor high-rise building of height less than 50 m, two layers of prefabricated concrete wall for heat insulation will be used inside exterior wall, each comprising a number of trough-type or L shaped prefabricated concrete wall units for heat insulation. Between two neighboring such units on the same layer, cast-in-place concrete wall vertical ribs are used to connect them to an integral. Two such units in two neighboring layers shall be arranged in a crossed way with opposing notches. Top of groove rib of the unit in one layer shall mate bottom of groove in the unit in the other layer. Upper and lower ends of vertical rib of cast-in-place concrete wall shall be connected to a floor beam.

In the present invention, at wall corners and at intersection between interior and exterior walls, cast-in-place concrete wall end columns are provided. Side face at intersection between wall and end column will be covered with heat insulation layer. Cast-in-place concrete wall end column connects a number of walls together.

At intersection between said link beam and wall, protruding teeth perpendicular to upper surface are provided on link beam and corresponding grooves are provided at lower end of prefabricated concrete panel to allow engagement of prefabricated concrete wall with the link beam below. At intersection between link beam upper end and prefabricated concrete panel lower end at two corners, steel plates and angles are embedded in link beam and prefabricated concrete panel respectively, and welded together for installation. At the other end of prefabricated concrete panel, connecting rebar perpendicular to end face are embedded, and will be connected to and fixed on reinforcement cage of cast-in-place link beam to form an integral part of such cage.

When this invention is used for high-rise building with heat insulation requirements, steel members will be embedded in prefabricated concrete wall for heat insulation. One end of the steel members is embedded in the concrete panels, and the other end is projected from the heat insulation layer of the prefabricated concrete wall for heat insulation. The steel members are connected and located along the prefabricated concrete wall to form reinforcement cage of cast-in-place concrete wall. In this way, upon completion of construction, prefabricated concrete wall for heat insulation and cast-in-place concrete wall will form superposed shear wall.

Aforesaid steel members can be T shaped and L shaped steel straps, or T shaped screw bolt or combination of screw bolt with inner bolt hole with screw bolt. Screw bolt of suitable length can be connected to screw bolt with inner bolt hole. Gaps are provided around steel members so that concrete can be filled in such gaps during site grouting of concrete wall to form concrete stubs and enhance shear strength between two concrete layers.

Prefabricated concrete wall for heat insulation is used as permanent formwork on outer surface of wall and serves as formwork during construction. Up on completion of construction, this prefabricated wall will constitute part of folded shear wall and bear part of the load. For grouting of concrete, structural measures of point connection can serve to fix formwork. When subject to load, coordinated operation of permanent formwork with composite layer and superposed layer grouted later can be ensured. Point connection mode can reduce cold (hot) bridge to a minimum, thereby increasing heat insulation efficiency of superposed wall.

At intersection between said link beam and wall, protruding teeth perpendicular to surface are provided on link beam and corresponding grooves are provided at lower end of prefabricated concrete panel to allow engagement of prefabricated concrete wall with the link beam below. At intersection between link beam upper end and prefabricated concrete panel lower end at two corners, steel plates and angles are embedded in link beam and prefabricated concrete panel respectively, and welded together for installation. At the other end of prefabricated concrete panel, connecting rebar perpendicular to end face are embedded, and will be connected to and fixed on reinforcement cage of cast-in-place link beam to form an integral part of such cage.

In this invention, outer surface of prefabricated concrete panel used as wall can be provided with ornamental motif or grooves for embedded pipelines, to replace additional (stuck) facing or avoid secondary cutting of grooves on wall surface, thereby saving investment and facilitating construction.

This invention provides a new energy saving building structure system, in which (factory) prefabricated concrete members for heat insulation is used as exterior wall, household division wall and floor slab, and also used as formwork for cast-in-place concrete part. This formwork needs not be removed and constitutes a permanent part of concrete wall structural system for heat insulation. With this technology, heat insulation performance of cast-in-place concrete building structure system has been improved, in line with development trend of building energy conservation. In addition, construction sequences have been reduced, and construction period shortened, reducing cost and solving the problem of complicated process of energy saving buildings.

In this invention, prefabricated concrete wall and floor slab formwork members are used to help positioning of cast-in-place concrete wall, beam and panel, so that cast-in-place concrete furring strips, stirrups and longitudinal rebar interact with prefabricated concrete members, to meet structural requirements, enhance integrity of prefabricated concrete members with cast-in-place concrete members, and enhance structural antiseismic performance.

This invention favors integrated design, modular production and installation, improved construction quality and accurate control of construction period. In addition, dry site operation can be performed, realizing factory fabrication of concrete buildings.

With this invention, buildings can more easily meet energy conservation standard, and obtained improved sound insulation and heat insulation performance. No separate heat insulation layer is required for the walls, hence room yield rate is high and secondary fitment is favored.

1—wall 2—link beam 3—floor slab 4—heat insulation layer 5—concrete panel 6—cast-in-place concrete wall end column 9—concrete floor slab 11—prefabricated concrete wall for heat insulation 12—cast-in-place concrete wall 13—prefabricated concrete wall unit for heat insulation 14—steel member 15—screw bolt 16—screw bolt with inner bolt hole 17—connecting rebar 21—protruding teeth 22—steel plate embedded in link beam 31—prefabricated concrete floor slab for heat insulation 32—cast-in-place concrete floor slab 51—groove 91—groove side rib 92—cross rib 93—spike dowel 52—angle steel embedded in prefabricated concrete panel

PREFERRED EMBODIMENT

The following further describes this invention in combination with preferred embodiment:

Preferred Embodiment 1

Figure 1:
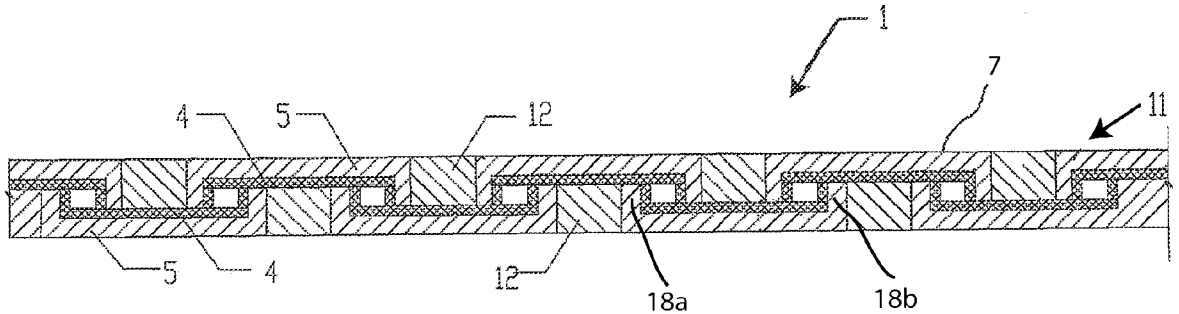
FIG. 1 is a structural schematic of wall of preferred embodiment 1 of this invention.
Figure 2:
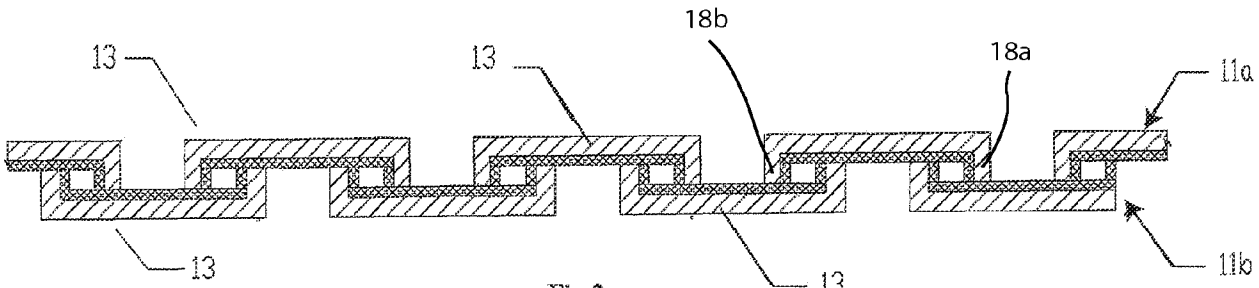
FIG. 2 is a structural schematic of prefabricated concrete wall for heat insulation of preferred embodiment 1 of this invention.

Refer to FIG. 1 and FIG. 2. A structure system of concrete building for self-heat insulation, comprising a wall 1, a link beam 2 and a floor slab 3. Two layers of prefabricated concrete wall for heat insulation 11*a* and 11*b* will be used inside exterior wall 1. Prefabricated concrete wall for heat insulation 11*a*, 11*b* is concrete panel 5 with heat insulation layer 4 on its interior surface. Concrete panel 5 has protruding edges 18*a*, 18*b*. Each layer of prefabricated concrete wall for heat insulation 11*a*, 11*b* comprises a number of trough-type or L shaped prefabricated concrete wall units for heat insulation 13. Between two neighboring such units on the same layer, cast-in-place concrete wall vertical ribs 12 are used to connect them to an integral. Two such units 13 in two neighboring layers shall be arranged in a crossed way with opposing notches. Top of groove rib of the unit 13 in layer 11*a* shall mate bottom of groove in the unit 13 in layer 11*b*.

Figure 3:
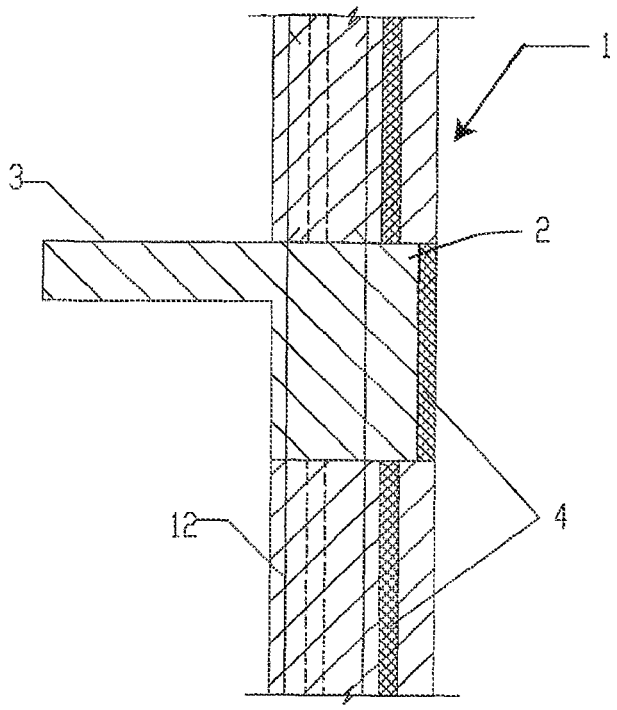
FIG. 3 is a structural side view of wall of preferred embodiment 1 of this invention.

Refer to FIG. 3. At intersection between link beam 2 and wall 1, prefabricated concrete wall for heat insulation is provided on link beam 2. Cast-in-place link beam 2 and upper and lower ends of vertical ribs 12 of cast-in-place concrete wall are cast to be an integral. Outer end face of link beam 2 is covered with heat insulation layer 4. At joint of floor slab 3 and link beam 2, cast-in-place link beam 2 and floor slab 3 are cast to be an integral.

Figure 4:
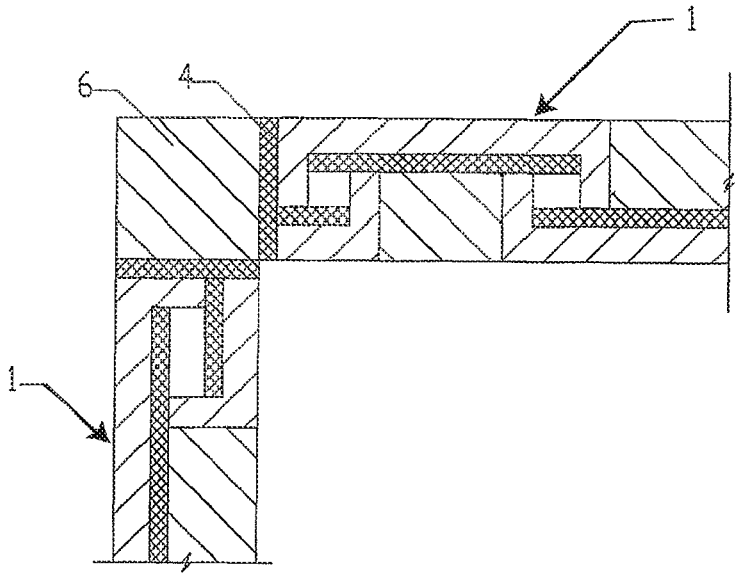
FIG. 4 is a structural schematic of wall corner of preferred embodiment 1 of this invention.

Refer to FIG. 4. At wall corners, cast-in-place concrete wall end column 6 is provided. Side face of intersection between wall 1 and end column is covered with heat insulation layer 4. Cast-in-place concrete wall end column 6 connects two walls 1 together.

Figure 5:
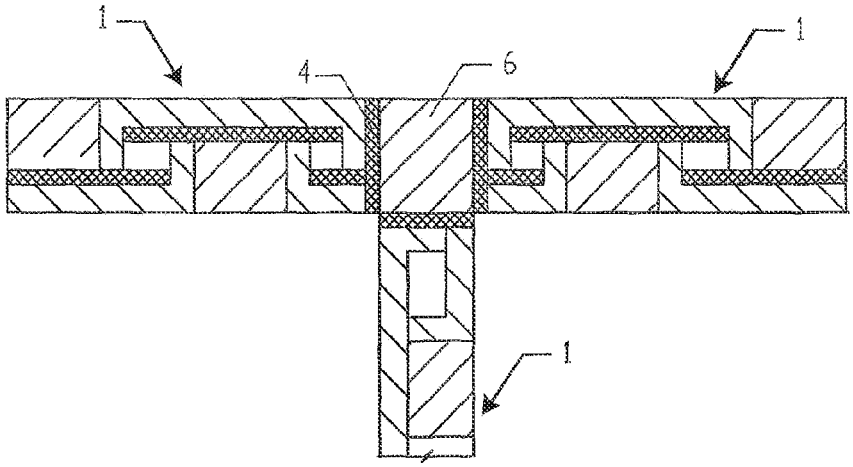
FIG. 5 is a structural schematic of intersection between interior wall and exterior wall of preferred embodiment 1 of this invention.

Refer to FIG. 5. At intersection between interior wall and exterior wall, cast-in-place concrete wall end column 6 is provided. Side face of intersection between wall and end column is covered with heat insulation layer 4. Cast-in-place concrete wall end column 6 connects three walls together.

Figure 6:
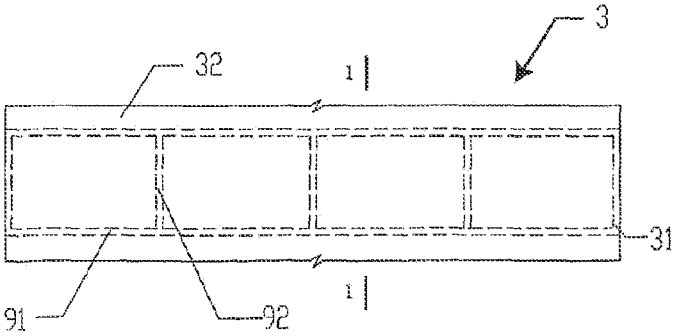
FIG. 6 is a structural schematic of floor slab of preferred embodiment 1 of this invention.
Figure 7:
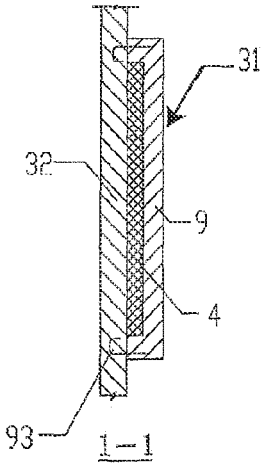
FIG. 7 is the 1-1 section of FIG. 6.

Refer to FIG. 6 and FIG. 7. Floor slab 3 includes prefabricated concrete floor slab for heat insulation 31 and cast-in-place floor slab 32. Prefabricated concrete floor slab for heat insulation 31 consists of groove shaped concrete floor slab 9 and heat insulation layer 4. Inside groove shaped concrete floor slab 9, cross ribs 92 are also provided. On groove side rib on groove shaped concrete panel 91 and cross ribs 92, spike dowel 93 is provided. Spike dowel 93 is fixed on reinforcement cage of cast-in-place concrete floor slab 32. Cast-in-place concrete floor slab 32 and prefabricated concrete floor slab for heat insulation 31 are cast to be an integral. Heat insulation layer 4 is clamped in between.

This preferred embodiment is applicable to multistory or minor high-rise concrete buildings of height less than 50 m.

Preferred Embodiment 2

Figure 8:
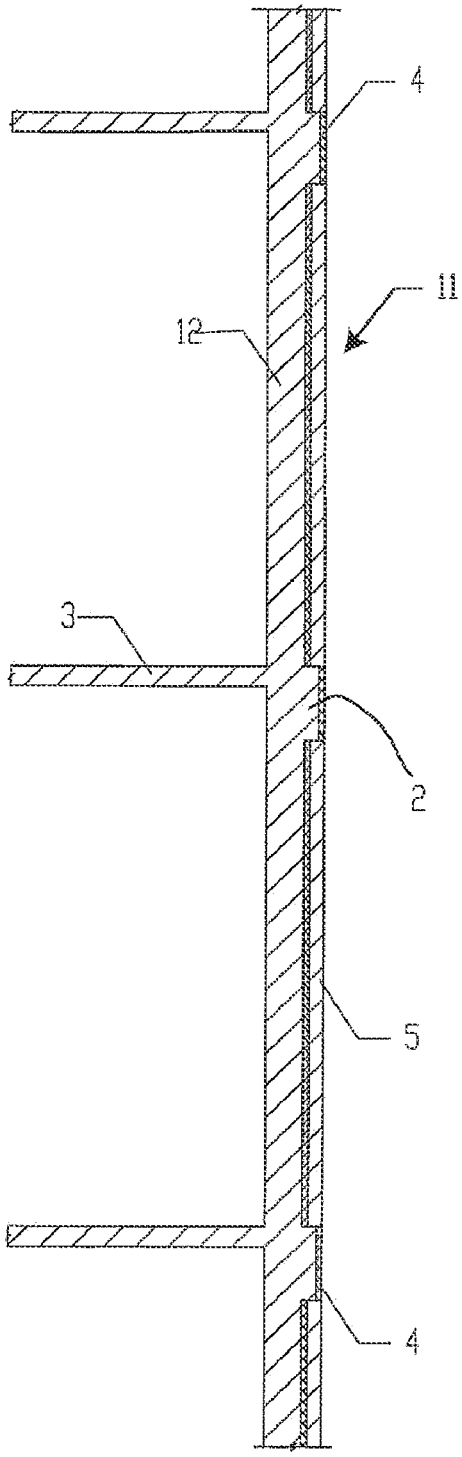
FIG. 8 is a structural schematic of building of preferred embodiment 2 of this invention.

Refer to FIG. 8. A structure system of concrete building for self-heat insulation, comprising a wall 1, a link beam 2 and a floor slab 3. Wall 1 consists of a prefabricated concrete wall for heat insulation 11 and a cast-in-place concrete wall 12. The prefabricated concrete wall for heat insulation 11 is a concrete panel 5, inner surface of which is covered with a heat insulation layer 4. The prefabricated concrete wall for heat insulation 11 and the cast-in-place concrete wall 12 are cast and folded to be an integral. At joint of said link beam 2 and an outer wall 1, cast-in-place link beam 2 and top and bottom cast-in-place concrete walls 12 are cast to be an integral. The outer end of the link beam 2 is covered with heat insulation layer 4.

Figure 9:
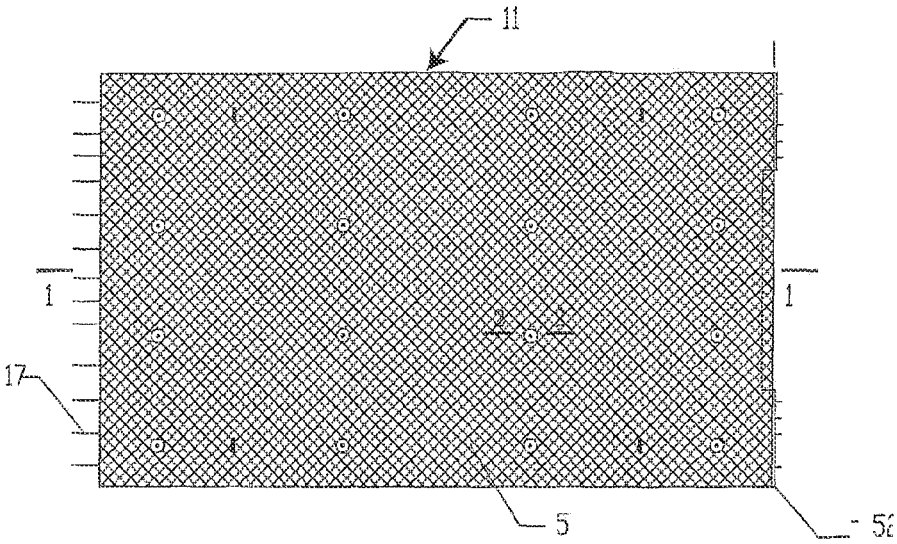
FIG. 9 is a structural schematic of prefabricated concrete wall for heat insulation of preferred embodiment 2 of this invention.
Figure 10:
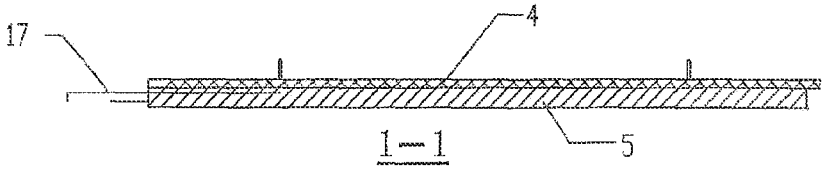
FIG. 10 is 1-1 section of FIG. 9.
Figure 11:
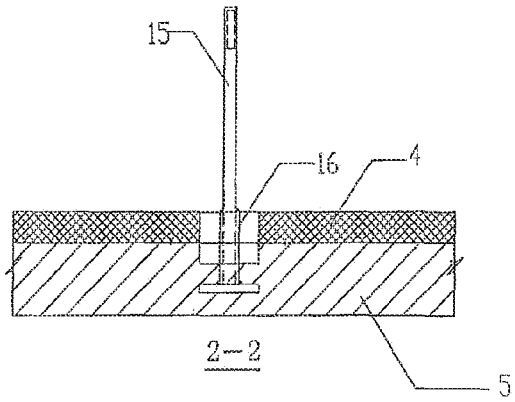
FIG. 11 is 2-2 section of FIG. 9.

Refer to FIG. 9, FIG. 10 and FIG. 11. In prefabricated concrete wall for heat insulation 11, screw bolts with inner bolt hole 16 are embedded in certain spacing. Screw bolt 15 is inserted in screw bolt with inner bolt hole 16 and projected from heat insulation layer 4 of prefabricated concrete wall for heat insulation. Screw bolts with inner bolt hole 16 provided at one side of prefabricated concrete wall for heat insulation are connected together to form reinforcement cage cast-in-place concrete wall. Gaps are reserved around screw bolt with inner bolt hole 16. Connecting rebar 17 perpendicular to end face is embedded in upper end of prefabricated concrete panel.

Figure 12:
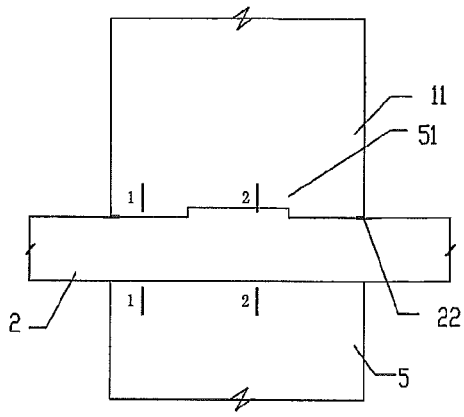
FIG. 12 is a structural schematic of wall and link beam node of preferred embodiment 2 of this invention.
Figure 13:
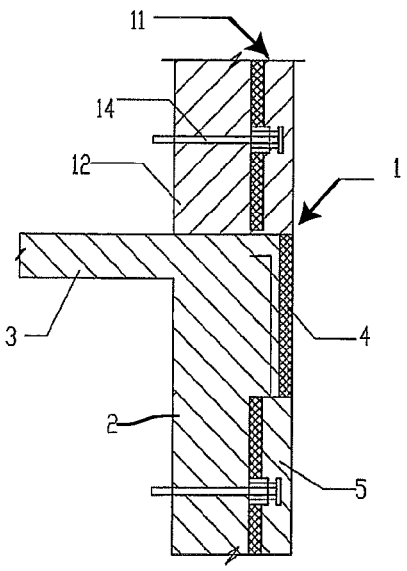
FIG. 13 is 1-1 section of FIG. 12.
Figure 14:
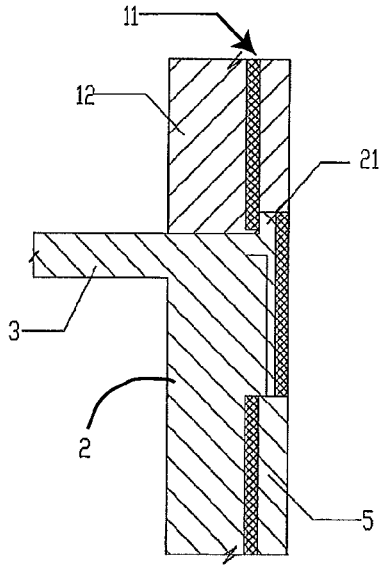
FIG. 14 is 2-2 section of FIG. 12.

Refer to FIG. 12, FIG. 13 and FIG. 14. At intersection between link beam 2 and wall 1, protruding teeth perpendicular to surface 21 are provided on link beam 2 and corresponding grooves 51 are provided at lower end of prefabricated concrete panel 5 to allow engagement of prefabricated concrete wall with the protruding teeth 21 below via grooves 51. At intersection between link beam 2 upper end and prefabricated concrete panel lower end at two corners, steel plates 22 and angles 52 are embedded in link beam and prefabricated concrete panel respectively, and welded together for installation. Connecting rebar 17 is fixed on reinforcement cage of cast-in-place link beam 2 to form an integral part of such cage.

Figure 15:
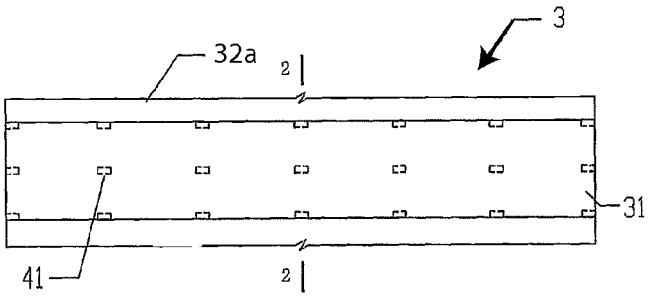
FIG. 15 is a structural schematic of floor slab of preferred embodiment 2 of this invention.
Figure 16:
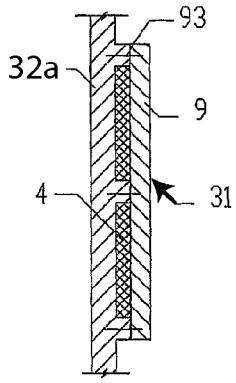
FIG. 16 is 2-2 section of FIG. 15.

Refer to FIG. 15 and FIG. 16. Floor slab 3 comprises prefabricated concrete floor slab for heat insulation 31 and cast-in-place concrete floor slab 32*a*. Prefabricated concrete floor slab for heat insulation 31 consists of concrete floor slab 9 and heat insulation layer 4. In concrete floor slab 9, nearly evenly distributed spike dowels 93 are provided. Holes 41 are made in heat insulation layer 4 at positions of spike dowels 93. One end of spike dowel 93 is projected from heat insulation layer 4.

This preferred embodiment is applicable to high-rise concrete shear wall structure system.

What is claimed is:

1. A structure system of a concrete building for self-heat insulation, comprising:

at least two heat insulated walls, each heat insulated wall including a first layer of prefabricated concrete panels spaced apart by a first plurality of cast-in-place concrete wall vertical ribs and a second layer of prefabricated concrete panels spaced apart by a second plurality of cast-in-place concrete wall vertical ribs, each of the prefabricated concrete panels of the first and second layers of prefabricated concrete panels having an inner surface, wherein the first and second layers of prefabricated concrete panels each have at least one concrete panel having two protruding edges;

a first heat insulating layer covering the inner surface of each of the prefabricated concrete panels of the first and second layers of prefabricated concrete panels forming the at least two heat insulated walls to form a continuous heat insulating barrier, the first heat insulating layer conforming to the inner surface of each of the prefabricated concrete panels;

a link beam disposed between the at least two heat insulated walls to connect the at least two heat insulated walls together, wherein an outer end face of said link beam is covered with an additional heat insulation layer to extend the continuous heat insulating barrier; and a floor slab cast to be integral with the link beam, the floor slab including a prefabricated concrete floor slab formed by a floor slab concrete panel having at least two protruding edges and a second heat insulating layer, and a cast-in-place floor slab, wherein the prefabricated concrete floor slab and the cast-in-place floor slab are cast to be integral;

wherein the second layer of prefabricated concrete panels of each of the at least two heat insulated walls is positioned opposite the first layer of prefabricated concrete panels of each of the at least two heat insulated walls such that each of the prefabricated concrete panels of the first layer of prefabricated concrete panels overlap a portion of at least one prefabricated concrete panel of the second layer of prefabricated concrete panels;

wherein the first and second layers of prefabricated concrete panels are cross-linked such that the protruding edges of the at least one concrete panel of the first layer of prefabricated concrete panels contacts the heat insulating layer that conforms to the inner surface of the second layer of prefabricated concrete panels.

2. The structure system of concrete building of claim 1, wherein the first and second layers of prefabricated concrete panels for heat insulation are used inside an exterior wall, wherein a plurality of cast-in-place concrete wall vertical ribs connect the prefabricated concrete panels together wherein an upper end and a lower end of the plurality of cast-in-place concrete wall vertical ribs is connected to the floor slab.

3. The structure system of concrete building of claim 1, wherein steel members are embedded in the at least two heat insulated walls, wherein a first portion of said steel members is embedded in the prefabricated concrete panels, and a second portion is projected through the first heat insulation layer, further wherein said steel members are connected and located along the heat insulated wall to form a reinforcement cage for the heat insulated wall.

4. The structure system of concrete building of claim 1, wherein an outer surface of said heat insulated wall is provided with at least one of an ornamental motif and grooves for embedded pipelines.

5. The structure system of concrete building of claim 1, wherein said floor slab comprises spike dowels provided and fixed on the reinforcement cage of the cast-in-place concrete floor slab.

6. The structure system of concrete building of claim 2, wherein at a wall corner and at an intersection between interior and exterior walls, a cast-in-place concrete wall end column columns is provided, wherein each side of the cast-in-place concrete wall end column contacting the heat insulated wall is covered with heat insulation layer further wherein the cast-in-place concrete wall end column connects at least one of the interior and exterior heat insulated walls together.

7. The structure system of concrete building of claim 3, wherein each of said steel member includes of a screw bolt and a screw bolt with an inner bolt hole, said screw bolt is inserted in the screw bolt with the inner bolt hole and projected through the first heat insulation layer, wherein gaps are provided around the screw bolt with the inner bolt hole.

8. The structure system of concrete building of claim 5, wherein at an intersection between said link beam and the heat insulated wall, a protruding tooth perpendicular to an upper surface of the link beam and corresponding grooves are provided at a lower end of the prefabricated concrete panels adjacent to the link beam to allow engagement of the heat insulated wall with the link beam, wherein steel plates and angles are embedded in the link beam and the prefabricated concrete panels adjacent to the link beam respectively, and welded together for installation, further wherein at the other end of the prefabricated concrete panels adjacent to the link beam, connecting rebar perpendicular to an end face are embedded, and is connected to and fixed on the reinforcement cage of the cast-in-place link beam.

9. The structure system of concrete building of claim 1, wherein the prefabricated concrete floor slab includes a number of cross ribs and spike dowels arranged therein.

10. The structure system of concrete building of claim 9, wherein in said prefabricated concrete floor slab, nearly evenly distributed spike dowels are provided on the floor slab concrete panel, wherein holes are reserved in the second heat insulation layer at the spike dowels, further wherein one end of the dowels is projected through the second heat insulation layer.

11. A structure system of a concrete building, comprising:

at least two heat insulated walls, wherein the at least two heat insulated walls include:

a first layer of prefabricated concrete panels spaced apart by a first plurality of cast-in-place concrete wall vertical ribs, wherein each of the prefabricated concrete panels of the first layer of prefabricated concrete panels have an inner surface and at least two protruding edges, a second layer of prefabricated concrete panels spaced apart by a second plurality of cast-in-place concrete wall vertical ribs disposed therein, wherein each of the prefabricated concrete panels of the second layer of prefabricated concrete panels have an inner surface and at least two protruding opposing edges, further wherein the second layer of prefabricated concrete panels is positioned opposite the first layer of prefabricated concrete panels;

a first heat insulating layer covering the inner surface of each of the prefabricated concrete panels to form a continuous heat insulating barrier, the first heat insulating layer conforming to the inner surface of the prefabricated concrete panels, wherein a union of the first heat insulating layer and the prefabricated concrete panels form a prefabricated concrete unit;

wherein the prefabricated concrete unit formed by the union of the heat insulating layer and the prefabricated concrete panels of the first layer is cross-linked with the prefabricated concrete unit formed by the union of the heat insulating layer and the prefabricated concrete panels of the second layer, such that the at least two protruding edges of the prefabricated concrete panels of the first layer of prefabricated concrete panels contact the first heat insulating layer conforming to the inner surface of the prefabricated concrete unit formed by the union of the heat insulating layer and the prefabricated concrete panels of the second layer;

a link beam disposed between the at least two heat insulated walls to connect the at least two heat insulated walls together, wherein an outer wall end face of said link beam is covered with an additional heat insulation layer; and a floor slab cast to be integral with the link beam, the floor slab including a prefabricated concrete floor slab formed by a floor slab concrete panel having at least two protruding edges and a second heat insulating layer, and a cast-in-place floor slab, wherein the prefabricated concrete floor slab and the cast-in-place floor slab are cast to be integral.

* * * * *

UNITED STATES PATENT AND TRADEMARK OFFICE

CERTIFICATE OF CORRECTION

PATENT NO. : 8,079,189 B2
APPLICATION NO. : 12/089736
DATED : December 20, 2011
INVENTOR(S) : Qu et al.

It is certified that error appears in the above-identified patent and that said Letters Patent is hereby corrected as shown below:

Column 7, Claim 6, Line 67, after the word "column" delete the word "columns"

Signed and Sealed this
Twenty-eighth Day of February, 2012

David J. Kappos

David J. Kappos
*Director of the United States Patent and Trademark Office*